US005403522A

United States Patent [19]

Von Berg

[11] Patent Number: 5,403,522

[45] Date of Patent: Apr. 4, 1995

[54] APPARATUS AND METHODS FOR MIXING LIQUIDS AND FLOWABLE TREATING AGENTS

[76] Inventor: Richard Von Berg, 4403 Alvin St., Saginaw, Mich. 48603

[21] Appl. No.: 152,273

[22] Filed: Nov. 12, 1993

[51] Int. Cl.[6] ..... B01F 3/04

[52] U.S. Cl. ..... 261/36.1; 261/76; 261/DIG. 75

[58] Field of Search ..... 261/DIG. 75, 76, 36.1

[56] References Cited

U.S. PATENT DOCUMENTS

| | | | |
|---|---|---|---|
| 1,747,687 | 2/1930 | Wheeler | 261/DIG. 75 |
| 2,017,867 | 10/1935 | Nantz | 261/DIG. 75 |
| 2,413,102 | 12/1946 | Ebert et al. | 261/DIG. 75 |
| 2,426,833 | 9/1947 | Lloyd . | |
| 2,812,168 | 11/1957 | Kumpman . | |
| 3,295,326 | 1/1967 | White . | |
| 3,374,990 | 3/1968 | Gray . | |
| 3,533,553 | 10/1970 | Britzman | 261/DIG. 75 |
| 3,704,008 | 11/1972 | Ziegler | 261/DIG. 75 |
| 3,780,198 | 12/1973 | Pahl et al. | 261/DIG. 75 |
| 4,041,981 | 8/1977 | Davis et al. | 261/DIG. 75 |
| 4,105,721 | 8/1978 | Schliebe . | |
| 4,308,138 | 12/1981 | Woltman | 261/DIG. 75 |
| 4,708,829 | 11/1987 | Bylehn et al. | 261/DIG. 75 |
| 4,710,325 | 12/1987 | Cramer et al. . | |
| 4,927,568 | 5/1990 | Campau . | |
| 4,973,432 | 11/1990 | Desjardins et al. . | |
| 5,085,678 | 2/1992 | Woltman . | |
| 5,091,118 | 2/1992 | Burgher | 261/DIG. 75 |

FOREIGN PATENT DOCUMENTS

| | | | |
|---|---|---|---|
| 7009279 | 12/1970 | Netherlands | 261/DIG. 75 |

*Primary Examiner*—Tim Miles

*Attorney, Agent, or Firm*—Learman & McCulloch

[57] ABSTRACT

Apparatus and methods for mixing a liquid and a flowable treating agent wherein liquid from a body thereof is pumped through a conduit submerged in the body of liquid and having a constricting nozzle therein which produces low pressure zone downstream of the nozzle. A draft tube communicates with the conduit in the vicinity of the low pressure zone and directs the flowable treating agent into the conduit by suction for mixing with the liquid. The nozzle outlet has a plurality of radially spaced slots separated by solid land portions which together interact with the fluid discharged from the nozzle to produce multiple, axially spaced venae contractae in the fluid downstream of the nozzle to effect mixing of the liquid and treating agent.

21 Claims, 2 Drawing Sheets

P
12
14
32
34
36
38
40
42
44
46
46a
46b
46c
48
50
52
54
56
58
60
62
64
66
72
74
76
78
82
84
86
88
VC1
VC2

APPARATUS AND METHODS FOR MIXING LIQUIDS AND FLOWABLE TREATING AGENTS

This invention relates generally to apparatus and methods for mixing liquids and flowable treating agents by aspiration and more particularly to nozzle configurations usable in such apparatus and methods.

BACKGROUND OF THE INVENTION

Various aspiration devices are known in which a fluid to be treated is introduced under pressure into a mixing conduit and passed through a nozzle constriction within the conduit to produce a differential low pressure zone downstream of the nozzle constriction. A gas inlet communicates with the low pressure zone to enable air or other gaseous treatment agents to be drawn by suction into the conduit for mixing with the fluid.

The nozzles known to be used heretofore typically employ a one dimensional, planar discharge orifice usually of circular cross-section which interacts with the fluid flowing through the nozzle to produce a single vena contracta downstream of the nozzle in the low pressure zone for mixing the liquid and gas.

An object of this invention is to improve the mixing capabilities of such apparatus by the use of an improved nozzle design.

SUMMARY OF THE INVENTION

Apparatus and methods for mixing a fluid and a flowable treating agent comprises fluid propulsion means for generating a directed flow of fluid through a passage of a mixing conduit for discharge through an outlet. A nozzle is accommodated in the conduit passage and has a side wall that tapers from the inlet toward the outlet end of the nozzle. The inlet end is in communication with incoming fluid for directing the flow of liquid through the nozzle. The tapered side wall produces a low pressure zone in the conduit and downstream of the nozzle outlet. Treating agent inlet means communicates with the conduit passage in the low pressure zone of the conduit for drawing the treating agent by suction into the conduit for mixing with the fluid therein. The outlet end of the nozzle has multiple venae contractae generating means interacting with the fluid discharging from the nozzle for producing multiple, axially spaced venae contractae in the low pressure zone for thoroughly mixing the fluid and treating agent.

The resultant multiple venae contractae increase the turbulence of the fluid within the conduit resulting in improved mixing of the fluid and treating agent as compared to conventional nozzles that produce only a single vena contracta. The multiple venae contractae also increase the energy efficiency in that a higher volumetric flow rate of fluid can be passed through the nozzle at a relatively lower velocity, as compared to the known prior art devices.

THE DRAWINGS

DETAILED DESCRIPTION

Figure 1:
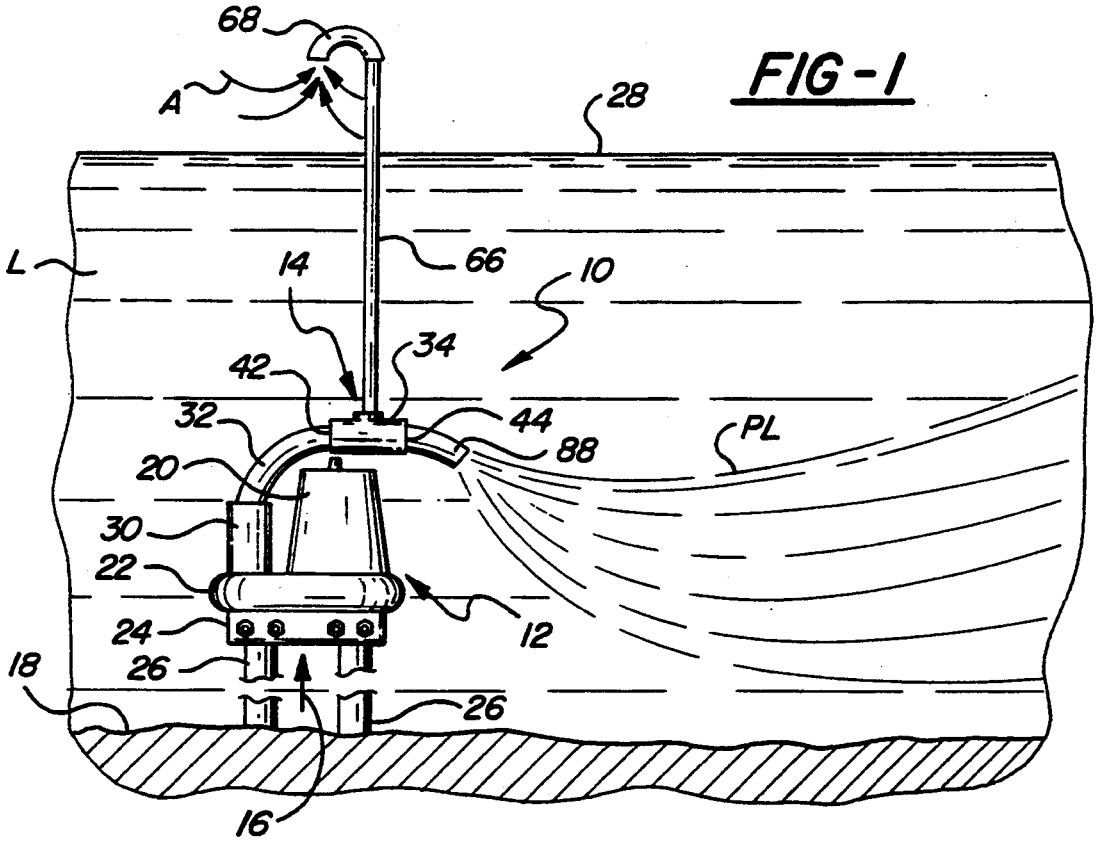
FIG. 1 is a fragmentary, side elevational view, partly in section, of the mixing apparatus submerged in the liquid to be treated.

Apparatus for mixing a fluid, such as a liquid, and a flowable treating agent constructed in accordance with a presently preferred embodiment of the invention is designated generally by the reference character 10 and comprises a pump 12 for generating a directed flow of the liquid into an aspirator assembly 14 communicating with the flowable treating agent and constructed so that the flow of the liquid through the aspirator assembly draws the treating agent into the flowing liquid by aspiration where it is thoroughly mixed with the liquid and discharged from the aspirator assembly.

The disclosed apparatus is intended primarily for use in treating water from lagoons, ponds, lakes, waste water treatment facilities, and the like, with one or more treating agents in order to increase the dissolved oxygen content of the water for purification, algae control, and fish rearing, or to introduce one or more known chemicals into the water to control aquatic life (e.g., mollusk, fish, and aquatic vegetation) and as such the description will be directed to such applications. It will be understood, however, that the apparatus has utility in applications other than treating water and may be used to treat other fluids.

As illustrated in FIG. 1, the pump 12 has an inlet (indicated by the arrow 16) in its bottom in communication with a source of the liquid L to be treated which may be water contained in a lagoon, pond, lake, or tank of a waste water treatment facility having a bottom 18. The pump 12 is preferably one that is completely submersible in water and may comprise a centrifugal impeller-type injector pump having an electric motor enclosed in a sealed motor housing 20 that drives a rotatable impeller (not shown) enclosed in the impeller housing 22. The pump 12 is commercially available. A mounting plate 24 is secured to the bottom of the pump 12 and is bolted or otherwise secured to a pair of stationary stakes 26 projecting above the bottom 18 of the pond or a dock post. Of course, other suitable mounting hardware may be used to support the pump 12 submerged beneath the surface 28 of the water L. The pump 12 is preferably supported at approximately 28 inches below the water surface.

The pump 12 has a preferably rigid outlet tube 30 projecting vertically upward from the impeller housing 22 and is coupled to and supports the aspirator assembly 14 by a rigid elbow connector 32, as shown in FIG. 1.

The aspirator assembly 14 includes a mixing conduit. 34 having a cylindrical tubular wall 36 the inner surface 38 of which defines a passage 40 extending through the conduit 34 between the inlet 42 and outlet 44 ends thereof. The liquid inlet end 42 is coupled in sealing engagement to the elbow connector 32 for receiving liquid from the pump for eventual discharge through the outlet end 44 of the conduit back into the body of liquid L. Like the pump 12, the mixing conduit 34 is submerged in the body of liquid L. The inner surface 38 of the conduit 34 is uniform in cross-section between the inlet and outlet ends.

A flow constricting nozzle 46 according to the disclosed embodiment is accommodated in the passage 40 for constricting the flow of the liquid as it passes through the mixing conduit 34 to produce a differential low pressure fluid zone 56 downstream of the nozzle outlet 52 and a mixing zone 58 in the conduit 34 downstream from the low pressure zone 56. The nozzle 46 has a continuous side wall 48 extending lengthwise between axially spaced inlet and outlet ends 50, 52 defining a nozzle passage 54 therebetween. The side wall 48 converges toward the outlet end 52 so that the nozzle passage 54 narrows progressively and uniformly from the inlet end 50 toward the outlet end 52. The nozzle 46 is supported within the passage 40 of the conduit 34 with the larger inlet end 50 of the nozzle 46 upstream of the relatively smaller outlet end 52 so that the flow of liquid introduced into the mixing conduit 34 by the pump 12 is directed through the nozzle 46 before discharge from the conduit 34. Preferably, the side wall of the nozzle 46 has a frusto-conical configuration with the wall being tapered at a cone angle of about 30° with respect to the central axis of the nozzle 46. Other cone angles are contemplated.

Figures 2, 5, 6, 7:
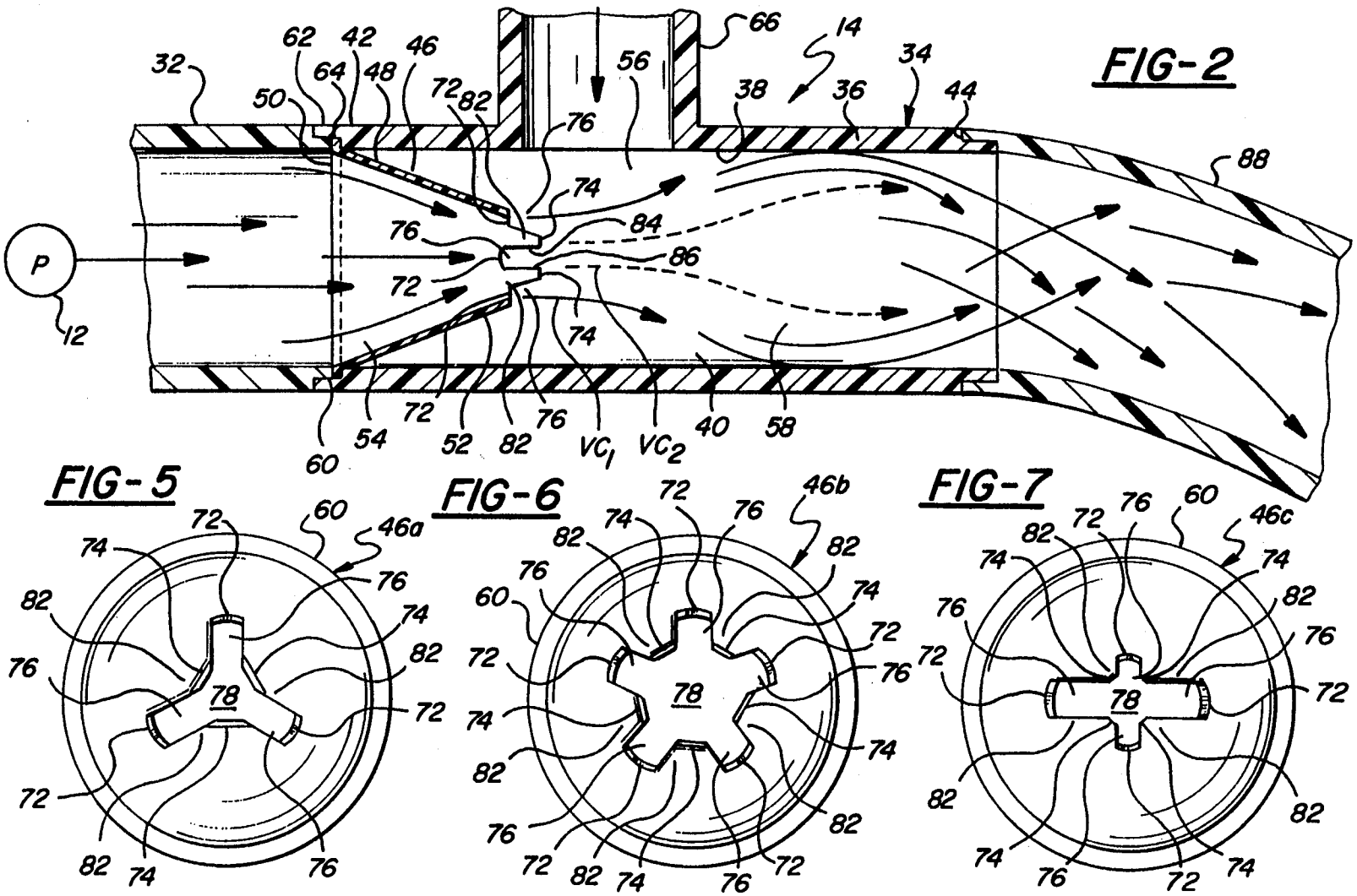
FIG. 2 is an enlarged, fragmentary sectional view of the aspirating assembly.

The nozzle 46 is provided with an annular flange 60 encircling its inlet end 50 for mounting the nozzle 46 within the passageway 40. As shown in FIG. 2, the abutting ends of the elbow connector 32 and the conduit 34 are joined in fluid tight engagement at a lap joint 62, capturing the flange 60 of the nozzle 46 in an annular groove 64 formed therebetween, thereby ensuring that all of the liquid entering the conduit 34 passes through the nozzle 46.

Figure 3:
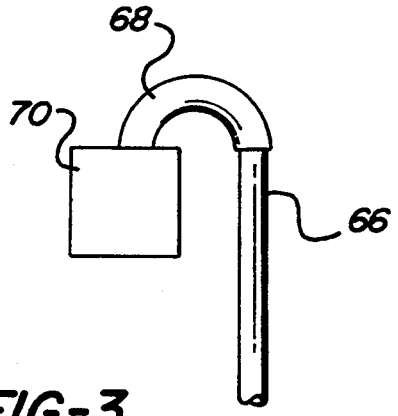
FIG. 3 is a fragmentary, elevational view showing the draft tube coupled to a supply of flowable treating agent.
Figure 4:
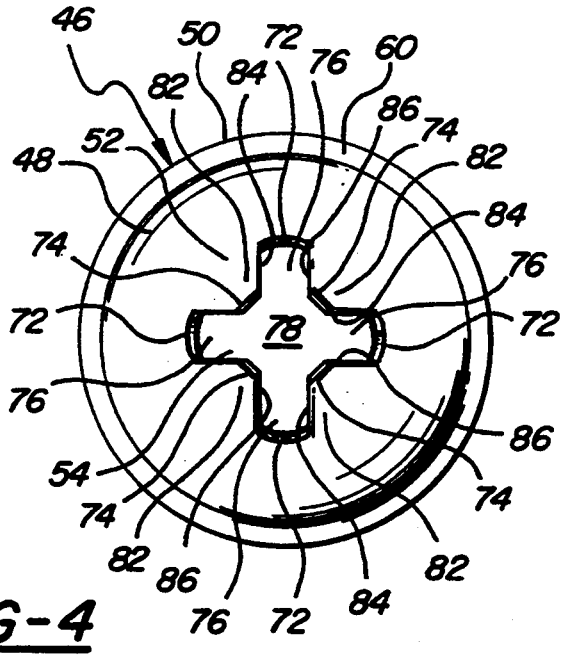
FIGS. 4 through 7 are end elevational views illustrating various nozzle configurations for use in the assembly of FIG. 2.

A draft tube 66 is coupled to the mixing conduit 34 between the ends of the conduit 34 downstream of the inlet end 50 of the nozzle 46 and preferably at the vicinity of the low pressure fluid region 56. Locating the draft tube 66 in the vicinity of the low pressure region 56 causes the treating agent to be drawn through the draft tube 66 into the conduit 34 by suction wherein the treating agent is entrained and mixed with the flowing liquid as it passes through the mixing zone 58. The draft tube 66 extends upwardly from the conduit 34 to an intake end 68 supported above the surface of the water 28 in communication with either atmospheric air A, as illustrated in FIG. 1, or a supply of any one or more other flowable treating agents in a container 70, as shown in FIG. 3. The treating agents contemplated are those that are presently used to treat water for purification, dechlorination, floatation of oils, and control of aquatic plant, fish, mollusk, algae, etc. Such flowable treating agents include oxidizers, such as ozone, chlorine, and ferric chloride, in addition to atmospheric air. Dissolved air floatation is used to flocculate solids from water for purification. Dissolved oxygen is used for fish rearing and water purification. The treating agent also may comprise a reducing agent, such as sodium bisulfate, sodium sulfite, sodium biosulfate, sodium nitrate, and sulfur dioxide.

The downstream positioning of the draft tube 66 in relation to the nozzle 46 assures that the nozzle is not contacted by the treating agent drawn into the mixing conduit 34 through the draft tube 66. The preferred material for the draft tube 66, conduit 34, and elbow connector 32 is schedule 80 PVC pipe. The nozzle 46 may be constructed of nylon or 304 stainless steel, depending on the application.

The outlet end 52 of the nozzle 46 is constructed to interact with the liquid exiting the nozzle 46 in such manner as to generate multiple, axially spaced venae contractae, designated as $VC_1$ and $VC_2$ in FIG. 2, downstream of the nozzle outlet end 52. The multiple venae contractae $VC_1$ and $VC_2$ are produced as a result of the liquid exiting the nozzle 46 from two axially spaced locations, designated 72 and 74 in FIG. 2. By discharging the liquid from the nozzle 46 at axially spaced locations 72 and 74, there are two regions downstream of the nozzle outlet in which the flow of fluid contracts to a minimum cross-section, the first of which, $VC_1$, occurs nearer the nozzle outlet end 52 as a result of a portion of the liquid exiting the first location 72, and the second of which, $VC_2$, occurs farther downstream as a result of another portion of the liquid exiting the second location 74. The largest pressure drop in liquid flow occurs at the venae contractae $VC_1$, $VC_2$ and the outlet end of the draft tube 66 preferably is located adjacent the venae contractae.

The discharge locations 72 and 74 are formed by a plurality of circumferentially spaced discharge slots 76 formed in the side wall 48 of the nozzle 46 and extending downstream toward the outlet end 52 which has a central aperture 78 defined by the free ends or tips of a plurality of land portions 82 separating each adjacent pair of discharge slots 76. The tips correspond to the second discharge location 74. Each slot 76 has a pair of opposing, parallel, longitudinal edges 84, 86 extending from the tips of the land portions 82 rearwardly toward the inlet end 50 of the nozzle 46 and terminating at a base of the slot, which extends perpendicularly to the edges 84, 86 and normal to the central axis of the nozzle at a location axially rearward and radially outward of each of the distal ends 80 of land portions 82, and corresponds to the first outlet location 72 of the nozzle 46. As illustrated in FIG. 2, the nozzle passage 54 is constricted downstream of both the base 72 of the discharge slots 76 and the tips of the land portions 82 to constrict the portions of fluid exiting the nozzle through both the slots 76 and tips of the land portions 82. Preferably, each base 72 is accurately concave.

As illustrated in FIG. 2 by solid line arrows, liquid delivered by the pump 12 into the conduit 34 initially has a unidirectional flow axially of the conduit 34. As the liquid enters the nozzle 46, however, the converging side wall 48 redirects the flow of the liquid radially inward, causing the liquid to accelerate as it advances through the nozzle passage 54 toward the outlet end 52.

The first opportunity for the liquid to escape from the nozzle 46 is at the base 72 of each of the slots 76. The liquid escaping from the slots 76 has both longitudinally forward and radially inward momentum causing the liquid flow of that portion of the fluid flow to continue to contract for a short distance downstream of the nozzle 46 to a region of smallest flow cross-section corresponding to the first vena contracta $VC_1$. Similarly, the portion of liquid flow within the solid land portions 82 escapes from the nozzle passage 54 upon reaching the free ends 74 of the land portions 82, axially downstream of the discharge slot bases 72, wherein that portion of the liquid flow contracts to a minimum cross-section axially downstream of the free ends 74 of land portions 82, producing the second vena contracta $VC_2$.

The slot bases 72 are spaced circumferentially about the perimeter of the nozzle 46 rearwardly of the tip ends 74 and, due to the taper of the side wall 48, the series of slot bases 72 provides a common nozzle opening larger in diameter than the opening provided by the tip ends 74. Consequently, the portion of the liquid exiting at the free ends 74 of the land portions 82 is compressed radially greater than that portion of liquid exiting the base 72 discharge slots 76 and accordingly escapes from the nozzle passage 54 with higher velocity and forms a cross-sectionally smaller vena contracta $VC_2$ as compared to the liquid exiting the discharge slots 76.

As the liquid portions flow beyond their corresponding venae contractae $VC_1$, $VC_2$, the pressure increases and the liquid portions expand radially outward toward the wall 36 of the conduit 34. However, because there are two venae contractae $VC_1$, $VC_2$ axially spaced from one another, the outward radial flow of the fluid from the second vena contracta $VC_2$ crosses the flow path of the liquid of the first vena contracta $VC_1$ producing a three dimensional, turbulent crisscrossing of the liquid downstream of the nozzle in the mixing zone 58. This flow pattern produces white water turbulence exposing a larger amount of the liquid to the treating agent drawn in through the draft tube 66 as compared to a flow of liquid produced from a single vena contracta, resulting in improved mixing of the liquid and treating agent downstream of the nozzle 46. Such a flow pattern also has the benefit of enabling lower liquid pressure to be utilized than with nozzles producing only a single vena contracta, enabling usage of less costly pumps and less energy while still effecting improved mixing.

Once the liquid and treating agent have been mixed in the mixing zone 58, they are discharged from the conduit 34 through the outlet end 44 back into the body of liquid (e.g. water) being treated. The white water turbulence in the mixing zone produces a plume PL of very fine bubbles in the body of water. To increase the effectiveness of treatment of the body of liquid, it is desirable to retain the bubbles in the body of liquid as long as possible. The longer the retention time, the greater is the opportunity for the treating agent carried by the bubbles to interact with the body of liquid. It therefore is desirable to provide a flow deflector 88 at the outlet end 44 of the conduit 34 for deflecting the liquid/treating agent mixture angularly downward in relation to the central axis of the conduit 34 toward the bottom of the body of water in order that the momentum of the flowing mixture carries it further below the surface of the water 28 before the downward momentum is overcome by buoyancy forces causing the bubbles to rise to the surface of the water 28. The deflector 88 may be formed of the same tubular material as the conduit 32.

FIGS. 4 through 7 illustrate various nozzle configurations that may be used to produce the multiple venae contractae flow pattern described above. The nozzle shown in FIG. 4 corresponds to the nozzle shown in section in FIG. 2. As illustrated, the nozzle 46 has four discharge slots 76 circumferentially spaced at approximately 90° spaced intervals. The rather large combined opening provided by the discharge slots 76 and tip ends 74 of the land portions 82 have the added advantage of enabling the passage of sticks, leaves, and other debris through the nozzle, as compared to round nozzle openings. The same is true for the nozzle configurations **46*a*, 46*b*, and 46*c* of FIGS. 5 through 7. The nozzle configurations of FIGS. 5 through 7 are identical to that described with reference to FIGS. 2 and 4 except that the number, relative size and circumferential spacing of the discharge slots 76 and land portions 82** vary. However, the modified nozzle constructions still produce multiple venae contractae complex fluid flow of the nature described above.

The nozzle **46*a* of FIG. 5 has three discharge slots 76 spaced approximately 120° from one another. The nozzle 46*b* of FIG. 6 has five such discharge slots 76 spaced approximately 72° from one another, whereas the nozzle 46*c* of FIG. 7 has four such discharge slots 76** arranged 90° from one another but having opposing pairs which are smaller in width and length than the remaining pair of slots.

It will be understood that various other nozzle configurations are possible and are contemplated within the scope of the invention if multiple axially spaced venae contractae are produced as a result of passing the flow of liquid through the nozzle.

The disclosed embodiments are representative of preferred forms of the invention, but are intended to be illustrative rather than definitive thereof. The invention is defined in the claims.

I claim:

1. Apparatus for mixing a fluid and a flowable treating agent comprising:

a fluid conduit;

propulsion means for generating a flow of the fluid through said conduit;

a nozzle in said conduit having an inlet and an outlet and a side wall converging in the direction of flow of said fluid to produce a low pressure fluid zone downstream of said nozzle outlet; and treating agent inlet means communicating with said conduit at said low pressure zone of said conduit for enabling a flowable treating agent to be drawn by suction into said conduit for mixing with the fluid in said conduit downstream from said nozzle outlet, said outlet of said nozzle having a plurality of circumferentially spaced openings in said side wall for producing multiple, axially spaced venae contractae downstream of said nozzle for mixing said fluid and said treating agent in said conduit.

2. The apparatus of claim 1 wherein said openings comprise slots extending axially from said outlet of said nozzle toward said inlet, each of said slots terminating in a base upstream from said outlet, said slots alternating with solid land portions each of which terminates in a free end downstream of said slot bases, thereby enabling a portion of said fluid to escape from said nozzle through said slots at said bases thereof and produce a first vena contracta, and another portion of said fluid to escape from said nozzle at said free ends of the land portions and produce a second vena contracta downstream of said first vena contracta.

3. The apparatus of claim 2 wherein said side wall forms a cone angle of about 30°.

4. The apparatus of claim 2 wherein each of said slots has a pair of opposed edges that are parallel and uniformly spaced between said outlet and said slot ends.

5. The apparatus of claim 2 wherein there are three of said slots.

6. The apparatus of claim 2 wherein there are four of said slots.

7. The apparatus of claim 2 wherein there are five of said slots.

8. The apparatus of claim 1 wherein said conduit has a discharge end configured to deflect the liquid/treating agent mixture discharged from said conduit downwardly.

9. The apparatus of claim 1 wherein said agent inlet means comprises a draft tube coupled at one end to said conduit and communicating at its opposite end with a source of said flowable treating agent.

10. The apparatus of claim 1 wherein said propulsion means comprises a pump submergible in the body of fluid to be treated.

11. The apparatus of claim 10 wherein said treating agent inlet means includes an aspirator coupled to said pump and submergible in the body of fluid to be treated.

12. The apparatus of claim 11 including mounting means for mounting said pump and said aspirator on a submerged support structure for supporting and locating said pump and said aspirator beneath the surface of the body of fluid to be treated.

13. A method of treating a body of liquid with a flowable treating agent comprising:

establishing a flow of liquid from said body of liquid axially through a longitudinally extending conduit submerged in said body of liquid;

passing the liquid through axially spaced outlets of a constricting nozzle within the conduit to produce axially spaced venae contractae within the conduit downstream of the nozzle; and introducing the flowable treating agent into the conduit in the vicinity of the venae contractae to effect mixing of the treating agent with the liquid.

14. The method of claim 13 including discharging the mixed liquid and treating agent from the conduit at a downward angle into the body of liquid.

15. The method of claim 13 including drawing the treating agent into the conduit by suction.

16. The method of claim 13 wherein the flowable treating agent is selected from the group consisting of a gas, another liquid, and flowable granular solid material.

17. The method of claim 13 wherein the treating agent is selected from the group consisting of oxidizers and reducing agents.

18. A nozzle for use in treating water flowing in a stream through a conduit, said nozzle comprising a wall forming a frusto-conical body having an inlet at its larger end and an outlet at its smaller end, said wall having a plurality of slots therein extending from said smaller end toward but terminating short of said larger end, said slots being circumferentially spaced from and substantially parallel to one another, said slots terminating between the smaller and larger ends of said body and defining openings through which liquid may escape from said body upstream from said outlet and form a first vena contracta in said conduit downstream of said nozzle, those portions of said wall between adjacent slots terminating at said larger end in free tips past which liquid from said nozzle may flow from said body and form a second vena contracta in said conduit downstream from said first vena contracta.

19. A nozzle according to claim 18 wherein said slots are substantially uniform in size.

20. A nozzle according to claim 18 wherein at least one of said slots has a length less than that of the remaining slots.

21. A method of treating a body of liquid comprising flowing liquid from said body axially through a longitudinally extending conduit; establishing a low pressure zone in said conduit; introducing a treating agent into said conduit at said low pressure zone; establishing multiple, axially spaced venae contractae downstream of the introduction of said treating agent into said conduit to mix said treating agent with liquid in said conduit; and returning the mixed liquid and treating agent to said body of liquid.

* * * * *